US006213351B1

(12) United States Patent
Stoneberg et al.

(10) Patent No.: US 6,213,351 B1
(45) Date of Patent: Apr. 10, 2001

(54) PUSH BODY VALVE CLOSURE

(75) Inventors: Thomas C. Stoneberg, Buffalo Grove; Gary Berge, Crystal Lake, both of IL (US)

(73) Assignee: Courtesy Corporation, Buffalo Grove, IL (US)

( * ) Notice: Subject to any disclaimer, the term of this patent is extended or adjusted under 35 U.S.C. 154(b) by 0 days.

(21) Appl. No.: 09/472,696

(22) Filed: Dec. 27, 1999

(51) Int. Cl.[7] ..... B67B 5/00

(52) U.S. Cl. ..... 222/153.14; 222/514; 222/525; 215/315

(58) Field of Search ..... 222/525, 508, 222/511, 513, 514, 515, 524, 518, 206, 496, 499, 153.14; 215/307, 311, 315, 387

(56) References Cited

U.S. PATENT DOCUMENTS

| | | | | |
|---|---|---|---|---|
| 75,937 | * | 3/1868 | Lawrence | 222/515 |
| 922,158 | * | 5/1909 | Landau | 222/315 |
| 1,205,545 | * | 11/1916 | Kendall | 222/525 |
| 2,210,206 | | 8/1940 | Fisher | 401/206 |
| 3,338,467 | | 8/1967 | Albert | 220/90.4 |
| 3,561,632 | * | 2/1971 | Shirae | 22/153.14 |
| 4,135,513 | | 1/1979 | Arisland | 128/252 |
| 4,238,045 | | 12/1980 | D'Andria | 220/90.4 |
| 4,979,648 | * | 12/1990 | Montgomery et al. | 222/153.14 |
| 5,328,063 | | 7/1994 | Beck et al. | 222/524 |
| 5,495,966 | | 3/1996 | Won | 222/508 |
| 5,607,073 | | 3/1997 | Forrer | 215/11.4 |
| 5,699,933 | | 12/1997 | Ho et al. | 220/703 |
| 5,850,908 | | 12/1998 | Jasek | 220/203.23 |
| 5,893,472 | | 4/1999 | Forrer | 215/11.4 |
| 5,947,345 | * | 9/1999 | Hofmann | 215/315 |

FOREIGN PATENT DOCUMENTS

| | | | | |
|---|---|---|---|---|
| 5944 | * | of 1883 | (GB) | 215/78 |

* cited by examiner

*Primary Examiner*—Kevin Shaver
*Assistant Examiner*—Stephanie Willatt
(74) *Attorney, Agent, or Firm*—Silverman, Cass & Singer, Ltd.

(57) ABSTRACT

A push body valve closure to dispense product retained in a container. The closure includes a base affixed to the mouth of the container and a cap cooperatively engaged upon the base and movable between a first closed position and a second opened position with respect to the base. The base is formed with a product dispensing channel having a wall with a generally conical-shaped cross-sectional configuration and the cap has a depending spring-action circumferential flange formed on the interior surface thereof for cooperative engagement with the conical-shaped wall. The cap is normally disposed in its closed position but is movable to the open position upon application of a force thereon to move the cap with the spring-action circumferential flange engaged against the conical-shaped wall. Upon removal of the force applied to the cap, the cap returns to its closed position by the force of the spring-action flange against the conical-shaped wall.

20 Claims, 6 Drawing Sheets

PUSH BODY VALVE CLOSURE

BACKGROUND OF THE INVENTION

1. Field of the Invention

This invention relates generally to dispensing closures for containers, and more particularly, to such closures which, after being opened, automatically return to their closed position to prevent unintentional dispensing of product from such containers.

2. Description of the Prior Art

Push body closures are known in which a cap or spout having a dispensing aperture is positioned upon a base with cooperative elements therebetween to permit the closure to be opened or closed by dis-engagement or engagement of the cooperative elements. The base is affixed to the mouth of a product container, such as a water bottle, and when a force is applied to the cap to move the cap with respect to the base, such as by pushing on the cap with the lips of a user, the cooperative elements between the cap and base are caused to disengage and thereby open the closure and permit product, such as water, in the container to be dispensed into the users's mouth for drinking by passing through the dispensing aperture in the cap.

It also is known to provide structure in such closures to effect automatic closing thereof from the opened condition after dispensing of the product is desired to be terminated. Such structure commonly includes return-engagement springs, levers or the like to cause the cooperative elements between the cap and the base to return to their engaged position when the force applied to the cap is released, thereby to close the closure and prevent unintentional further dispensing of product from the container, such as if the container inadvertently is tipped over.

The push body valve closures of the prior art generally include relatively complex and involved structure which is difficult to manufacture, such as by molding process for plastic closures, and/or includes fragile elements which are susceptible to breakage. Accordingly, it is desirable to provide a push body valve closure of the type described in which the cap and base portions preferably are formed of molded plastic material which is relatively uncomplex in construction and thereby easy to manufacture, and also does not include fragile elements that are susceptible to breakage.

The present invention provides a structure which accomplishes the above objectives of a push body valve closure, as well as including a locking feature which prevents movement of the closure cap to its open position with respect to the base unless and until the cap is first moved to an unlocked position.

SUMMARY OF THE INVENTION

The invention is characterized by a push body valve closure including a base adapted to be secured to the mouth of a container for product to be dispensed therefrom, and a cap engaged upon the base and moveable with respect thereto between a first closed position and a second opened position. A product dispensing channel is formed in the base to be in communication with the container mouth, and includes an aperture through which such product may be dispensed. A portion of the wall of the channel is of generally conical-shaped cross-sectional configuration.

The cap includes a depending spring-action circumferential flange formed on the interior surface of the cap for cooperative engagement with the conical-shaped wall portion of the channel. The uppermost surface of the cap has an orifice formed therein and a depending plug is secured to the cap at a location which is in registry with the orifice. The plug is positioned to be in cooperative engagement with the aperture of the product dispensing channel when the cap is disposed in a first closed position with respect to the base.

Upon engagement of a force against the cap, such as by the lips of a user, the cap is moved to a second opened position with respect to the base in which the plug is withdrawn from the aperture and the depending spring-action circumferential flange is engaged against the conical-shaped wall portion of the channel. In such opened position, product retained in the container may be dispensed through the aperture in the channel and out of the orifice in the cap, and into the user's mouth. The cap remains in its opened position with respect to the base so long as the force continues to be applied thereto to resist the spring-action of the circumferential flange against the conical-shaped wall of the channel which causes the cap to be directed back to its closed position.

Upon disengagement of the force against the cap, as when the user disengages his lips from the cap, the spring-action of the circumferential flange of the cap acts against the conical-shaped wall of the channel to cause the cap to be directed back to its closed position in which the plug is engaged within the aperture of the channel, thereby preventing further dispensing of product from the container unless and until a force is re-applied against the cap.

A keying slot and locking notch are formed on the spring-action circumferential flange and a keying rib is formed on the surface of the conical-shaped wall portion of the channel for cooperative engagement to lock the cap in its open position and prevent unintentional movement of the cap to its open position unless and until the cap is rotated on the base. Indicia are applied to the external surface of the cap and base to visually indicate when the cap is in its locked/unlocked position.

Various objects and advantages of the invention will become apparent in accordance with the above and ensuing disclosure in which a preferred embodiment is described in detail in the specification and illustrated in the accompanying drawings. It is contemplated that minor variations may occur to persons skilled in the art without departing from the scope or sacrificing any of the advantages of the invention.

DESCRIPTION OF THE PREFERRED EMBODIMENT

Figure 1:
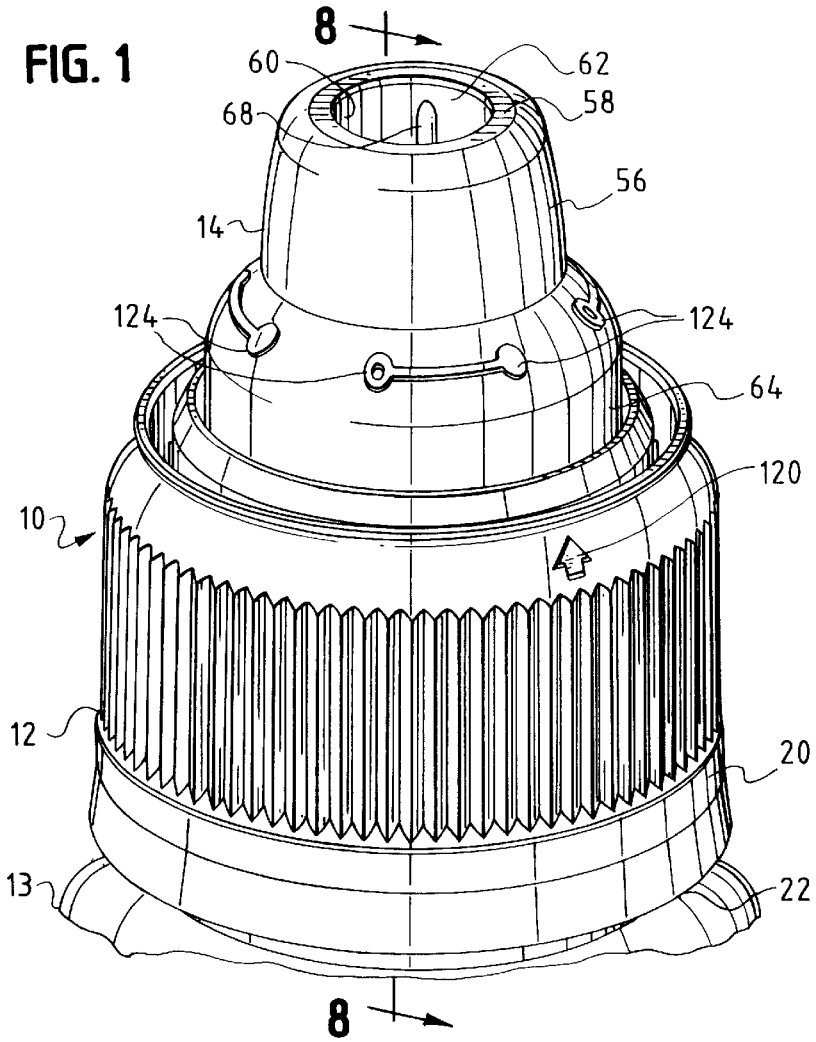
FIG. 1 is a perspective view of the push body valve closure of the invention, the same being shown with the cap in its closed and locked position with respect to the base.

Referring to the drawings, the push body valve closure 10 of the invention preferably is formed of molded plastic material and includes base 12 and cap 14 engaged upon the base. The base 12 is adapted for attachment to the mouth of a container top 13 in known manner, such as by screw threads 16 formed on the inner surface 18 of base 12 which mate with like threads on the mouth of the container.

Base 12 includes a generally cylindrical-shaped body portion 20 with an open end 22 to be applied to the mouth of a container top 13 as described above, and an opposite end 24 having a base closure wall 28 extending generally normal to the body portion 20. An elongate dispensing channel 30 is formed upon base closure wall 28 and has a first end 32 which opens into the body portion 20 and a second terminal end 34 spaced from said closure wall 28. A platform 36 is formed within dispensing channel 30 at a location between said first end 32 and said second end 34 thereof, with an aperture 38 provided within and through platform 36 to permit product which is introduced into the channel 30 to be dispensed through the aperture 38.

The wall 40 of elongate dispensing channel 30 is formed with a first portion 42 disposed proximate to first end 32. Wall portion 42 is of generally conical-shaped cross-sectional configuration. Wall 40 also includes a second portion 44 of generally cylindrical-shaped cross-sectional configuration extending from the first portion 42 to said second terminal end 34 of channel 30. The two wall portions 42, 44 are joined together along joining line 46 which defines shoulder 48 that provides a resting surface 50 (see FIG. 8) for a purpose to be described hereinafter. An upstanding circumferential wall 52 is formed upon base closure wall 28 spaced from the conical-shaped wall portion 42 and defines a generally U-shaped channel 54 upon base 12.

Cap 14 includes a spout 56 having an external wall 58 formed with an orifice 60 opening to the internal surface 62 of the spout 56. A depending circumferential skirt 64 is connected to the spout 56 at a location spaced from the orifice 60.

A closure plug 66 is positioned within spout 56 on the internal surface 62 thereof and depends from an area proximate to, and in registry with, orifice 60 by mounting spokes 68. Plug 66 includes a generally cylindrical-shaped body portion 70 with bulging wall surface 72 and a circular platform 74 formed across one end 76 of cylindrical body portion 70 to close same. Mounting spokes 68 extend from platform 74 of plug 66 to the internal surface 62 of spout 56. A depending, spring-action circumferential flange 78 is formed upon cap 14 and is positioned proximate to skirt 64. Flange 78 is arranged concentrically with skirt 64, and spaced radially inwardly with respect thereto.

Figure 8:
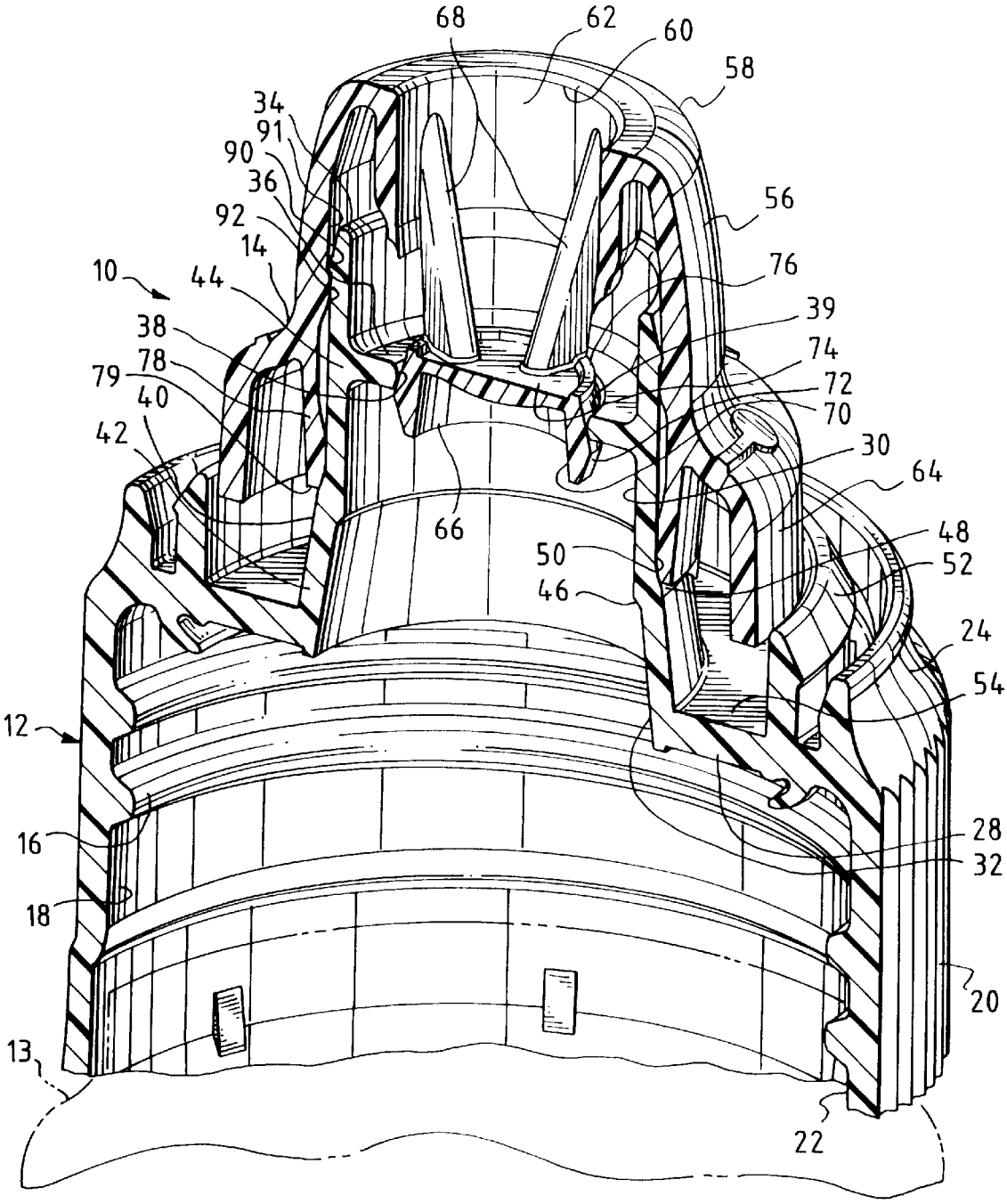
FIG. 8 is a sectional view taken along the line 8—8 of FIG. 1, in the direction indicated generally.

As seen in FIG. 8, cap 14 is adapted to be positioned upon base 12 in the closed disposition of closure 10 with closure plug 66 in cooperative engagement with aperture 38. In such disposition, the circumferential wall 39 of aperture 38 functions as a seat for plug 66 against which bulging wall surface 72 engages to seal aperture 38. Also in such disposition, spring-action circumferential flange 78 rests upon resting surface 50 of shoulder 48 (see FIG. 8). In this closed position of cap 14 with respect to base 12, product is prevented from passing through dispensing channel 30 and out orifice 60 because closure plug 66 seals aperture 38.

Figure 5:
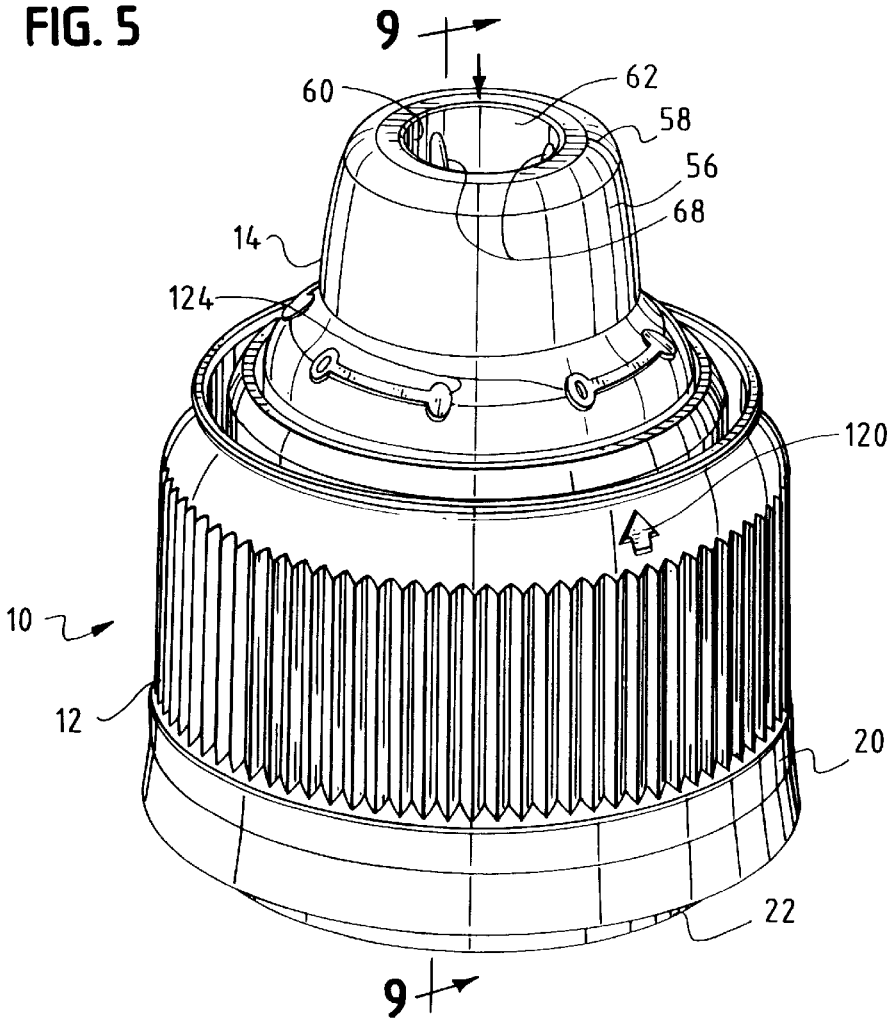
FIG. 5 is a perspective view similar to that of FIG. 3, but with the cap shown in its opened position with respect to the base.
Figure 9:
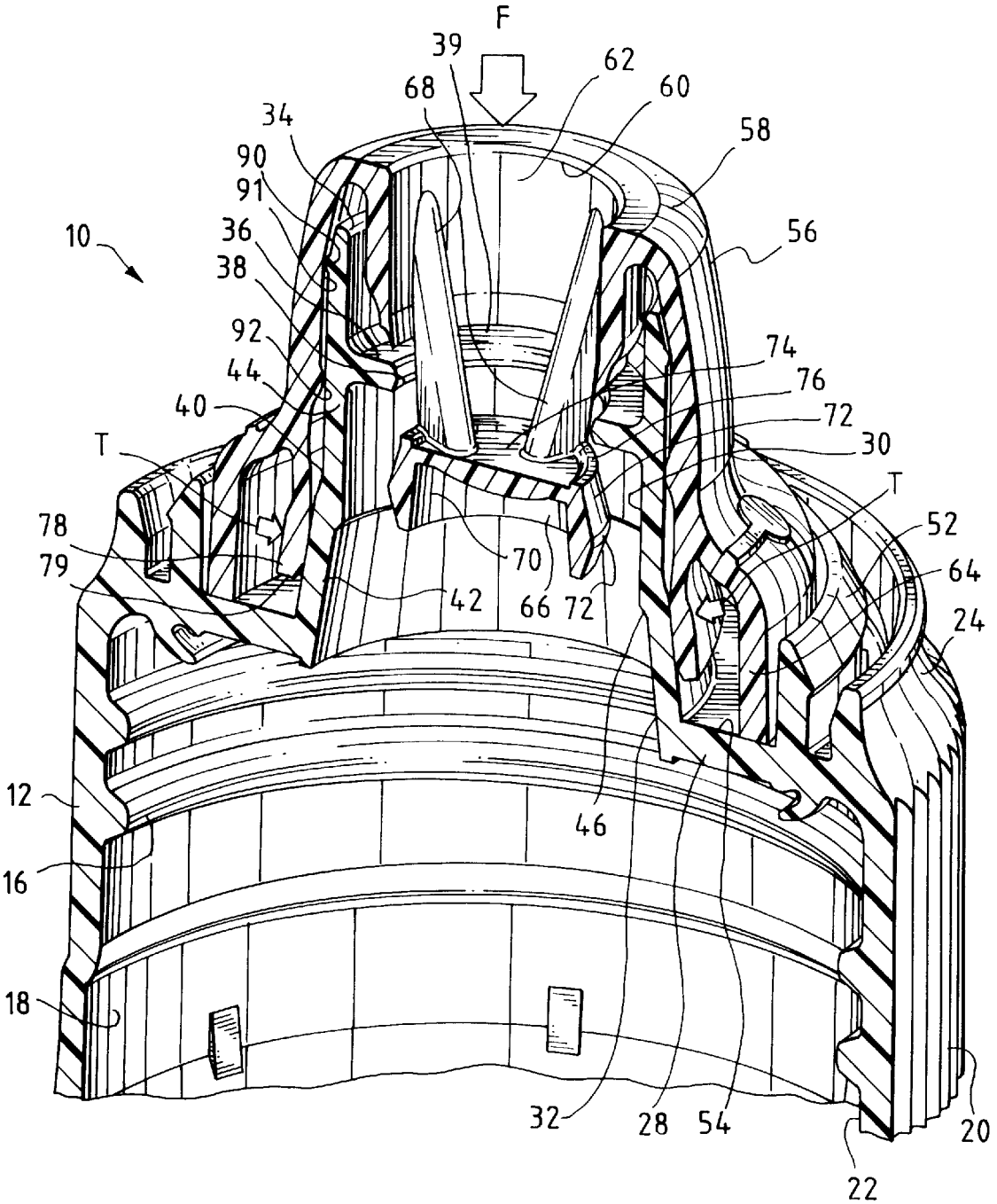
FIG. 9 is a sectional view taken along the line 9—9 of FIG. 5, in the direction indicated generally.

As seen in FIGS. 5 and 9, cap 14 is movable upon base 12 to an opened disposition of closure 10 by application of a force F against spout 56, such as by the lips of a user (not shown). Upon application of force F,. the closure plug 66 is withdrawn from its engagement in aperture 38 and the aperture thereby is opened to permit product to pass therethrough and be dispensed through channel 30 and out orifice 60.

When force F is applied to spout 56, depending spring-action circumferential flange 78 is moved off of resting surface 50 (FIG. 8) of shoulder 48 and engages against conical-shaped wall portion 42 of channel 30 in cam-like action (FIG. 9). The spring-action flange 78 is maintained in tensioned engagement with wall portion 42, as indicated by arrows T in FIG. 9, so long as force F is continued to be applied to spout 56. Upon release of force F, such as by disengagement of the lips of a user therefrom, the spring-action of flange 78 against conical-shaped wall 42 causes the cap 14 automatically to be directed or cammed back to its closed position with respect to base 12 (FIG. 8).

When cap 14 is in its opened position with respect to base 12, skirt 64 and concentric flange 78 are disposed within U-shaped channel 54 to prevent product contamination from being returned to container top 13 through closure 10. Additionally, terminal end 34 of dispensing channel 30 has a spill back seal 90 formed thereon to engage against the interior wall 91 of spout 56, and/or retaining ring 92 formed on said interior wall 91, to prevent product contamination through container top 13 when the closure is in its opened disposition.

Cap 14 and base 12 are provided with cooperative elements to lock and unlock same and thereby to prevent the cap from inadvertently being moved from its closed disposition (FIG. 8) to its opened disposition (FIG. 9). Referring to FIGS. 2, 4, 6 and 7, a pair of keying slots 100, 100' are formed on spring-action circumferential flange 78 at locations spaced approximately 180 apart. A portion of the terminal edge 79 of flange 78 adjacent to each slot 100, 100' is formed with a locking notch 110, 110' which extends along the edge 79 to a respective abutment surface 112, 112'. A pair of keying ribs 114, 114' are formed on the surface 43 of conical-shaped wall 42 to cooperatively engage keying slots 100, 100' and locking notches 110, 110'.

Figure 6:
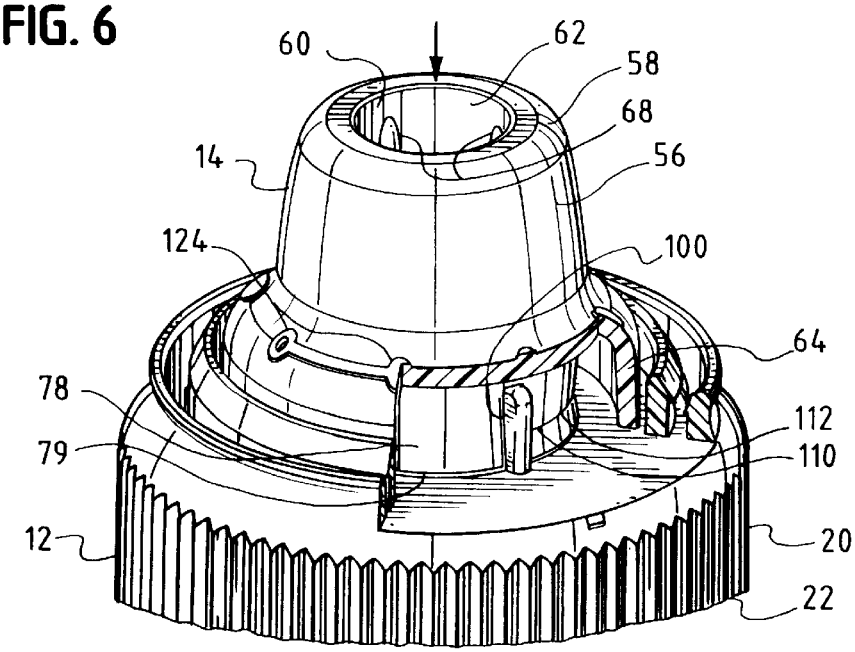
FIG. 6 is a perspective view similar to that of FIG. 5, but with the portions of the cap and base broken away to show details thereof.
Figure 7:
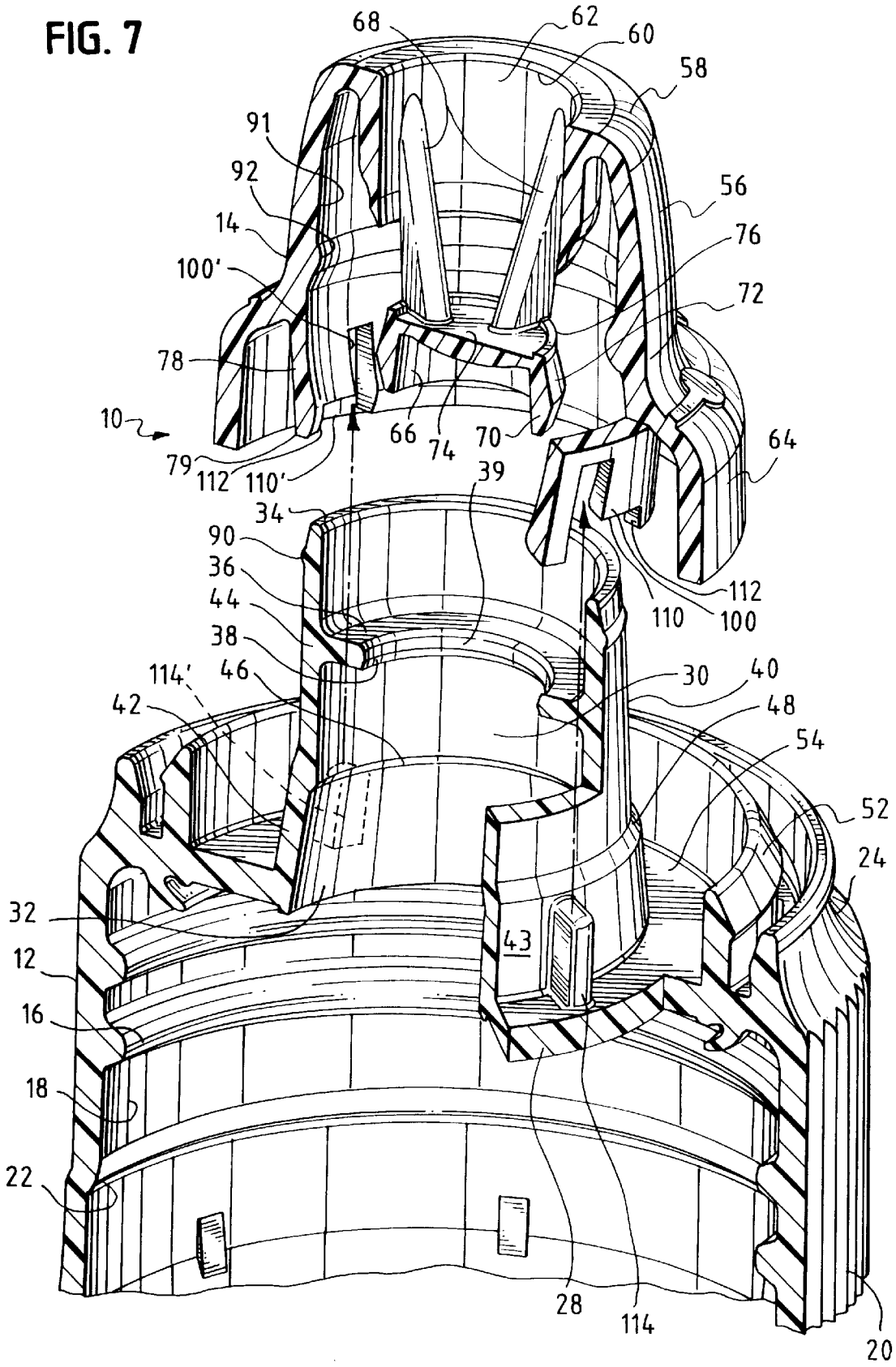
FIG. 7 is an exploded perspective sectional view of the closure of the invention.

When cap 14 is in its closed but unlocked and ready to be moved to opened disposition (FIGS. 3 and 4), keying slots 100, 100' on cap 14 are aligned with keying ribs 114, 114' on base 12, to permit the cap to be moved downwardly with respect to the base into the opened position (FIGS. 5–6 and 9). In this position, slots 100, 100' pass over ribs 114, 114'. Cap 14 can be rotated on base 12 (as indicated by arrows 125 in FIGS. 3 and 4) to its closed and locked position seen in FIGS. 1–2. When so rotated, keying ribs 114, 114' engage against abutment surfaces 112, 112' of locking notches 110, 110' and cap 14 cannot be depressed to its opened position because of engagement of the keying ribs within the locking notches.

Figure 2:
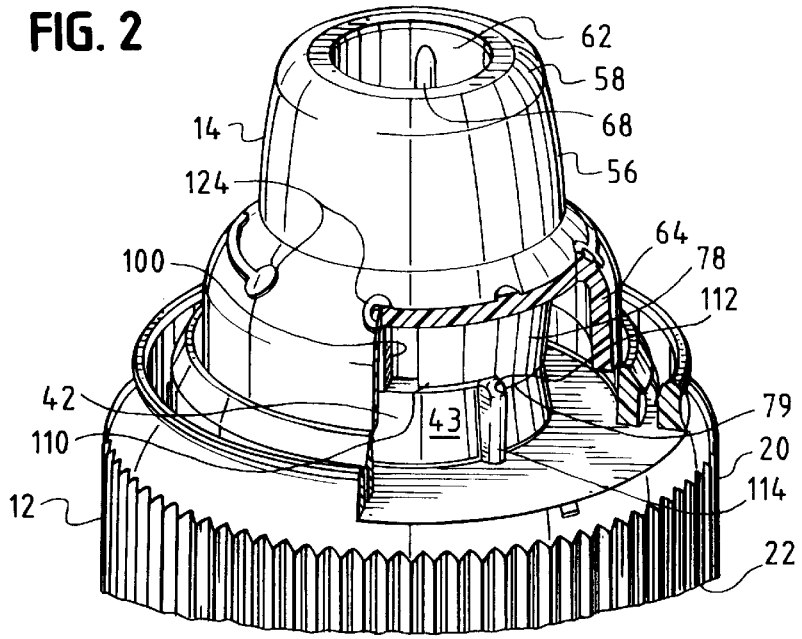
FIG. 2 is a perspective view similar to that of FIG. 1, with portions of the cap and base broken away to show details thereof.
Figure 3:
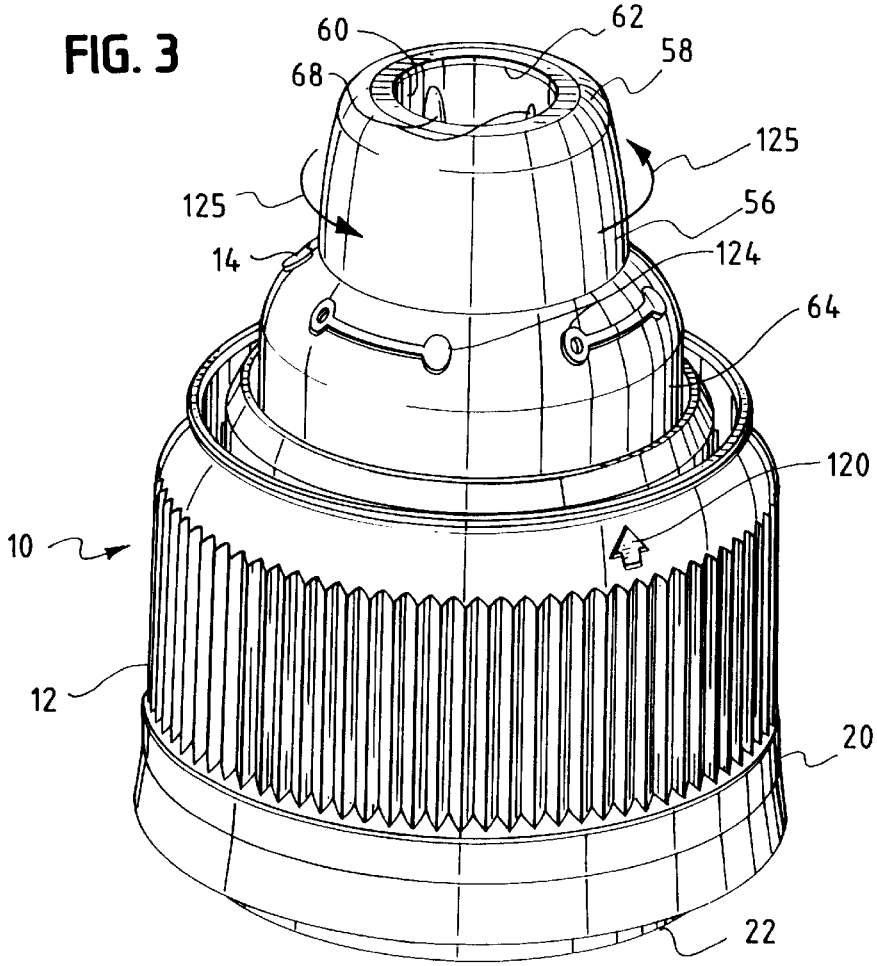
FIG. 3 is a perspective view similar to that of FIG. 1, but with the cap shown in its unlocked ready to open position with respect to the base.
Figure 4:
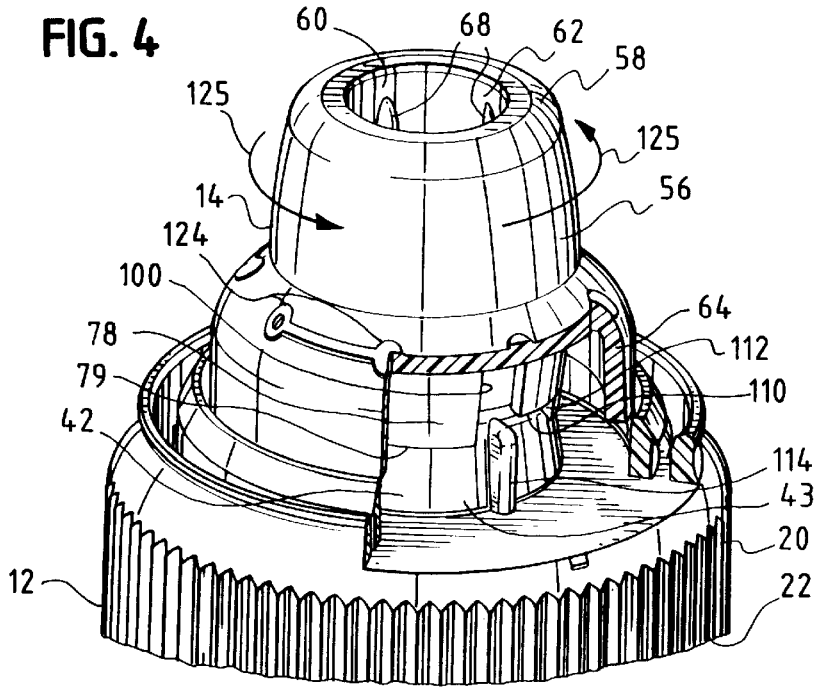
FIG. 4 is a perspective view similar to that of FIG. 3, with portions of the cap and base broken away to shown details thereof.

Indicia such as arrows 120 on the external surface of base 12 and open/closed circles 124 on the external surface of cap 14 are provided to visually indicate when the closure is in its unlocked ready to open position (FIGS. 3, 4) and in its closed and locked position (FIGS. 1 and 2).

The closure 10 is such that it remains in its opened position to permit dispensing of product therethrough only so long as force F is applied to spout 56. Upon release of the force F, the cap 14 automatically is returned to its closed position to prevent unintentional further dispensing of product, such as if the container to which the closure is applied inadvertently is tipped over.

Other configurations and variations in the structure, arrangement and size of the various parts may occur to those skilled in the art without department from the spirit or circumventing the scope of the invention as set forth in the appended claims.

What is claimed is:

1. A push body valve closure comprising, a base adapted to be secured to the mouth of a container for product to be dispensed therefrom, a cap engaged upon the base and movable with respect thereto between a first closed position and a second opened position, a product dispensing channel formed in the base and in communication with the container mouth, said channel having an aperture therein through which the product may be dispensed, said channel having a wall and a portion of the wall being of generally conical-shaped cross-sectional configuration, said cap including a spring-action circumferential flange for cooperative engagement with the conical-shaped wall portion of the channel, the cap having an orifice formed therein opening to the external surface of the cap and a dispensing plug secured to the cap at a location which is in registry with the orifice, said plug being positioned to be in cooperative engagement with the aperture when the cap is disposed in said first closed position with respect to said base.

2. A closure as defined in claim 1 in which said plug is withdrawn from engagement with said aperture when the cap is moved to its second opened position upon application of a force against said cap, and said spring-action circumferential flange is engaged upon said conical-shaped wall portion in tensioned engagement therewith when said cap is in said second opened position.

3. A closure as claimed in claim 2 in which the cap remains in said second opened position only so long as said force continues to be applied thereagainst.

4. A closure as claimed in claim 3 in which the spring-action flange automatically moves along the conical-shaped wall portion upon removal of the force against the cap to cause the cap to return to its first closed position.

5. A closure as claimed in claim 1 in which the channel includes a wall portion of generally cylindrical-shaped cross-sectional configuration joined along a joining line to said wall portion of generally conical-shaped cross-sectional configuration, said joining line defining a shoulder upon which said spring-action circumferential flange rests when said cap is in its first closed position.

6. A closure as claimed in claim 1 including cooperative means between said cap and base to lock and unlock same and thereby prevent the cap from inadvertently being moved between its first closed position and its second opened position.

7. A closure as claimed in claim 6 in which said cooperative means include at least one keying slot on said cap and at least one keying rib on said base.

8. A closure as claimed in claim 7 in which said keying slot is formed on the spring-action flange and the keying rib is formed on the conical-shaped wall portion.

9. A closure as claimed in claim 8 including at least one locking notch formed on the spring-action flange in proximity to said keying slot.

10. A closure as claimed in claim 6 including indicia provided on said cap and base to visually indicate to a user when said cap is in its lock position or unlock position.

11. In combination, a container having a mouth and a push body valve closure for said container, said container adapted to retain product to be dispensed therefrom, said closure comprising, a base adapted to be secured to the mouth of the container, a cap engaged upon the base and movable with respect thereto between a first closed position and a second opened position, a product dispensing channel formed in the base and in communication with the container mouth, said channel having an aperture therein through which the product may be dispensed, said channel having a wall and a portion of the wall being of generally conical-shaped cross-sectional configuration, said cap including a spring-action circumferential flange for cooperative engagement with the conical-shaped wall portion of the channel, the cap having an orifice formed therein opening to the external surface of the cap and a depending plug secured to the cap at a location which is in registry with the orifice, said plug being positioned to be in cooperative engagement with the aperture when the cap is disposed in said first closed position with respect to said base.

12. The combination as defined in claim 11 in which said plug is withdrawn from engagement with said aperture when the cap is moved to its second opened position upon application of a force against said cap, and said spring-action circumferential flange is engaged upon said conical-shaped wall portion in tensioned engagement therewith when said cap is in said second opened position.

13. The combination as claimed in claim 12 in which the cap remains in said second opened position only so long as said force continues to be applied thereagainst.

14. The combination as claimed in claim 13 in which the spring-action flange automatically moves along the conical-shaped wall portion upon removal of the force against the cap to cause the cap to return to its first closed position.

15. The combination as claimed in claim 11 in which the channel includes a wall portion of generally cylindrical-shaped cross-sectional configuration joined along a joining line to said wall portion of generally conical-shaped cross-sectional configuration, said joining line defining a shoulder upon which said spring-action circumferential flange rests when said cap is in its first closed position.

16. The combination as claimed in claim 11 including cooperative means between said cap and base to lock and unlock same and thereby prevent the cap from inadvertently being moved between its first closed position and its second opened position.

17. The combination as claimed in claim 16 in which said cooperative means include at least one keying slot on said cap and at least one keying rib on said base.

18. The combination as claimed in claim 17 in which said keying slot is formed on the spring-action flange and the keying rib is formed on the conical-shaped wall portion.

19. The combination as claimed in claim 18 including at least one locking notch formed on the spring-action flange in proximity to said keying slot.

20. The combination as claimed in claim 16 including indicia provided on said cap and base to visually indicate to a user when said cap is in its lock position or unlock position.

* * * * *